United States Patent [19]

Vystrcil et al.

[11] 4,406,311

[45] Sep. 27, 1983

[54] WEFT GUIDING COMB FOR A JET LOOM

[75] Inventors: Karel Vystrčil, Brno; Vladimír Vašíček, Moravský Krumlov; Vladimír Kuda, Blažovice, all of Czechoslovakia

[73] Assignee: ZVS Vyzkumnevyvojovy ustav konecernova ucelova organizace, Brno, Czechoslovakia

[21] Appl. No.: 266,657

[22] Filed: May 26, 1981

[30] Foreign Application Priority Data

Jun. 5, 1980 [CS] Czechoslovakia ..... 3961-80

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,958,609 5/1976 Zollinger et al. ..... 139/435

FOREIGN PATENT DOCUMENTS 21128 1/1981 European Pat. Off. ..... 139/435

2010905 3/1970 Fed. Rep. of Germany ..... 139/435

2031958 4/1980 United Kingdom ..... 139/435

*Primary Examiner*—Henry Jaudon

[57] ABSTRACT

A weft guiding comb of a jet loom wherein the weft is inserted across the shed by a stream of fluid carrying medium. The comb contains relay bodies located under the lower warp threads of the shed at the reed. The reed consists of flat dents to beat up the inserted weft to the fabric, the wall of which adjacent to said lower warp threads of the shed is one part of the weft guiding comb wall. Such wall is provided with saw-toothed projections, the face surfaces of which at least in the moment of the weft insertion carry the lower warp threads of the shed, and in the faces of which, transverse to the direction of the weft insertion, there are the mouths of the relay nozzles pointing in the direction of the weft insertion. The other part of the weft guiding comb wall are the backs of the reed dents, said dents being above the wall of the relay body with saw-toothed projections provided with nose extensions, the length of which corresponds with the width of the back surface of the relay body saw-toothed projections.

7 Claims, 6 Drawing Figures

WEFT GUIDING COMB FOR A JET LOOM

This invention relates to a weft guiding comb for a jet loom. In such loom the weft is inserted across the shed by a stream of fluid-carrying medium.

In jet looms having pneumatic weft insertion, a weft guiding comb is usually made as a plate comb disposed on a slay and periodically penetrating during the weaving motion into the shed through the lower warp threads. The form of the plate is essentially a split ring the interior circumference of which conically narrows in the direction toward the shed to direct the air stream. When weaving fabrics of greater widths, the plate assembly of the comb contains active plates provided with relay nozzles designed to equalize the air stream velocity loss in the weft guiding comb.

A significant disadvantage of this type of weft guiding comb is the increased stress upon the overhung reed, because with regard to the nessecity to slip the inserted weft out from the comb and to beat it up into the fabric, the weft guiding comb must move as far as under the binding point. A further great disadvantage of this embodiment is a relatively short time provided for weft insertion, because such insertion can be carried out only with the plate comb fully in the shed, and the weft beat up can be carried out only with the plate comb fully out of the shed. It is therefore possible to attain higher machine speeds only with a sufficiently prolonged dwell of the slay in the insertion position; this disproportionally increases the stress upon the whole slay mechanism. Another shortcoming of such apparatus is the danger of damage to the warp threads during passage of the plates through said warp threads, as well as its limitation to the use of dense warps.

A further known embodiment of weft guiding comb for insertion of weft into the shed by means of an air stream is made as a pair of relay bodies provided with saw-toothed projections. Each face of said saw-toothed projections is provided with a relay nozzle pointing in the direction of weft insertion. At the moment of weft insertion, said relay bodies are moved from the outside to the upper and lower warp threads of the shed, while the saw-toothed projections penetrate into the shed space.

The disadvantage of this embodiment is the creation of a comparatively large insertion space, which brings about considerable demands for the consumption of the carrying medium, in this case compressed air. Another disadvantage is the necessity to deflect the relay bodies when beating the weft up into the fabric, and to return them again when inserting the weft. This, together with a considerable consumption of compressed air, practically excludes its use in high speed looms.

The present invention has among its objects the provision of a weft guiding comb which eliminates the above outlined disadvantages and shortcomings of the prior art. The weft guiding comb in accordance with the invention contains relay bodies located under the lower warp threads of the shed at the reed. The reed has flat dents to beat up the inserted weft to the fabric. The wall of the relay body adjacent to said lower warp threads of the shed being one part of the weft guiding comb wall and being provided with saw-toothed projections. The back or upper surfaces of the saw-toothed projections at least at the moment of weft insertion carry the lower warp threads of the shed, and in the faces of the saw-toothed projections which lie transverse to the direction of weft insertion there are disposed mouths of the relay nozzles pointing in the direction of weft insertion. The other part of the weft guiding comb wall is constituted by the backs of the reed dents, while said dents are provided with nose extensions situated above the back surfaces of the saw-toothed projections of the relay body. The length of said nose extensions corresponds to the width of the back surface of the saw-toothed projections of the relay body.

In preferred embodiments of the invention the backs of the nose extensions of the reed dents are parallel with the back surface of the relay body saw-toothed projections, or at least in a part of the weft guiding comb length the distance between the backs of the nose extensions of the reed dents and the back surfaces of the saw-toothed projections of the relay body decreases in the direction toward the binding point of the fabric.

The weft guiding comb according to the present invention has many advantages over the prior art. On the one hand, it reduces the stress upon the reed because the beat-up of the inserted weft is carried out by the lower part of the reed near the position of its fixing in the slay. Further, it enables the reduction of the consumption of the fluid-carrying medium, because the relay nozzles form a small angle with the weft insertion direction. Another great advantage of the weft guiding comb according to the present invention is the fact that it permits the attainment of high-speed loom operation, and thus an increase of the output of the loom since weft insertion is realizable over two-thirds of the loom cycle. This also means that the drive for the slay can be designed practically without a dwell with an acceptable degree of stress of its mechanism even at high speeds of the loom.

The invention will more readily understood upon consideration of the accompanying drawings, in which.

Figure 1:
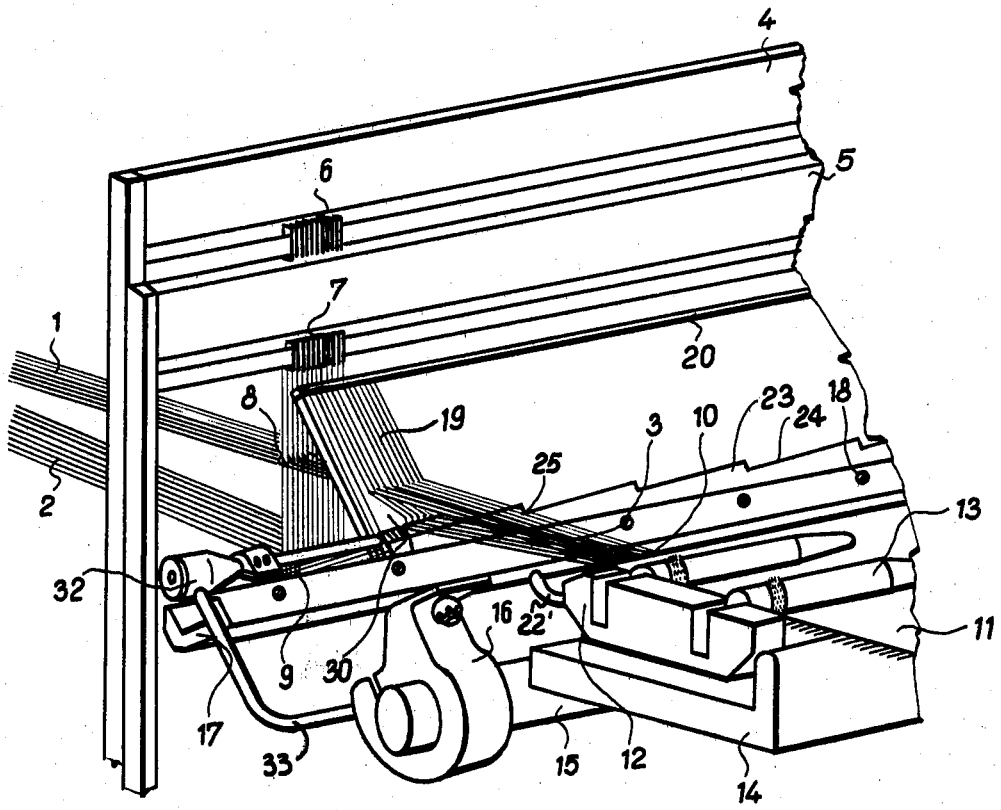
FIG. 1 is a fragmentary view in perspective of a jet loom, such figure specifically showing the weft insertion part thereof.
Figure 2:
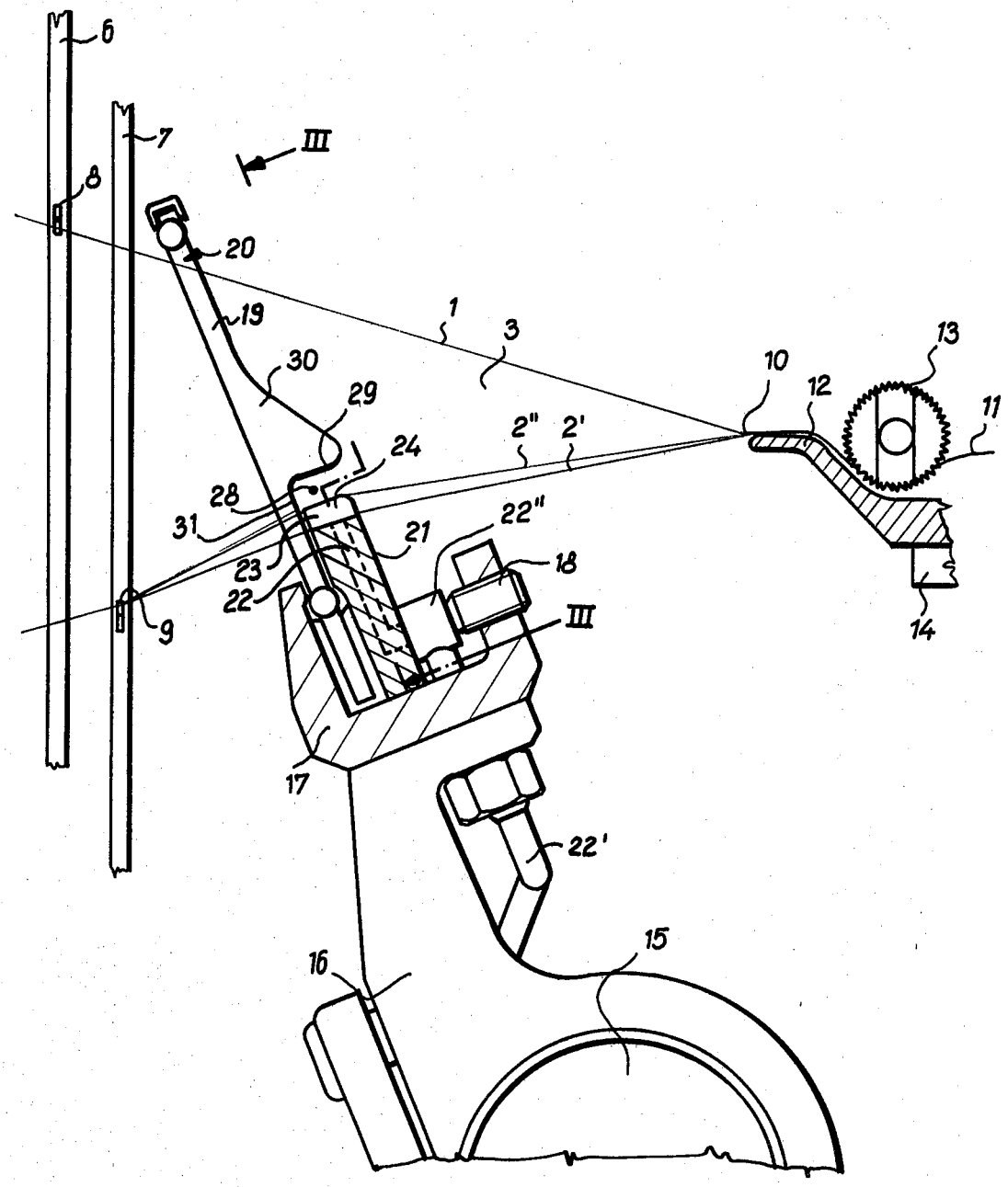
FIG. 2 is a fragmentary view, partially in end elevation and partially in vertical section, the elevation being taken in a direction from left to right in FIG. 1.
Figure 3:
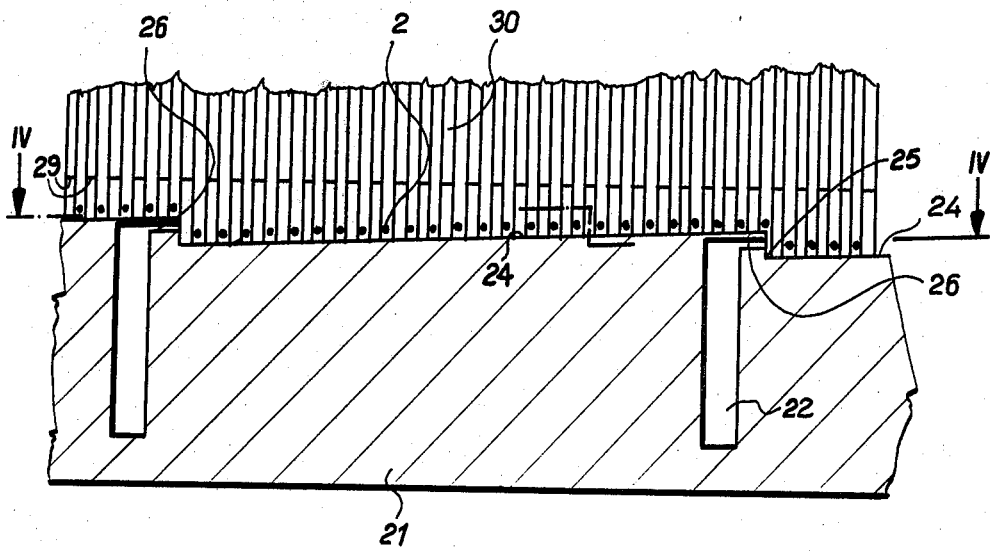
FIG. 3 is a fragmentary view in section of the weft guiding comb, the section being taken along the line III—III in FIG. 2.

Turning first to FIGS. 1 to 4, inclusive, in a fragmentarily shown pneumatic jet loom upper and lower warp threads 1 and 2 respectively creating a shed 3 are fed from a warp beam (not shown). As shown in FIGS. 1 and 2, warp threads 1 and 2 pass through heald eyes 8 and 9 of healds 6 and 7 respectively, the healds being mounted on harness frames 4 and 5 respectively. The warp threads 1 and 2 are fed forwardly up to the binding point 10 of the woven fabric 11. Fabric 11 is fed over a support 12, over a temple 13 mounted on a breast beam 14, and on to a cloth beam (not shown).

The loom is provided with swords 16 (one shown) which are fixedly mounted upon a swing shaft 15 which is driven in oscillation by a machine drive (not shown). Swords 16 carry a slay 17 into which a reed 20 with flat dents 19 and a relay body 21 are fixed along the length of the shed as by screws 18. The relay body 21 is located on slay 17 under the lower warp threads, generally designated 2 of shed 3, the body 21 which abuts the lower threads 2 forming one part of the wall of the weft guiding comb. Such wall of body 21 is provided with saw-toothed projections 23 of uniform widths, as shown in FIG. 1, the upper or back surfaces 24 of which carry the lower warp threads 2 at at least the moment of insertion of the weft 28 into the shed. The projections 23 rise from the root of one shoulder to the peak of the next succeeding shoulder in the direction from left to right (FIG. 1). In the faces or shoulders 25 of the saw-toothed projections 23 there are provided the mouths of relay nozzles 26 which point in the direction of insertion of the weft 28. In the embodiment shown in FIG. 4, there are provided at least two nozzles 26, 27, which are shown as being parallel. Such two nozzles, however, can also be disposed one above each other, or at the same level and skewed with respect to each other, so long as they all point in generally the direction of weft insertion.

The weft insertion mechanism is provided with a main weft inserter nozzle 32 suitably provided with air under pressure at time intervals through a conduit 33. The relay nozzles 26 (or 26 and 27 in FIG. 4) are provided with cyclically timed air under pressure through a supply conduit 22' which, as shown in FIG. 2, is connected to a distributor 22'' extending longitudinally of the shed. Distributor 22'' is connected to a plurality of vertically disposed fluid conduits 22, there being one conduit 22 for each nozzle 26 or set of nozzles 26, 27.

The other part of the weft guiding comb wall is created by backs 29 of dents 19 of the reed 20. Such backs 29 in their beat-up part 31 are provided with nose extensions 30 above the upper wall or surface 23 of relay body 21. The lengthd of the nose extension 30 of the dents 19 corresponds with the width of the back surface 24 of the saw-toothed projections 23 of relay body 21. The longitudinally profile of the weft guiding comb wall created by backs 29 of nose extensions 30 of dents 29 is shown parallel with the direction of insertion of the weft 28. However, such longitudinal profile can also have a saw-toothed shape, which, as well as the relay body 21, narrows in the direction of insertion of the weft 28.

In the embodiment of FIG. 2 the backs 29 of the nose extensions 30 of dents 19 of the reed 20 are parallel with the back surface 24 of the saw-toothed projections 23 of the relay body 21. But usually it is more suitable when the distance between the backs 29 of the nose extensions 30 of dents 19 and the back surface 24 of the saw-toothed projections 23 of relay body 21 decrease in the direction toward the binding point 10, if need be down to the thickness of the support 12 for the fabric 11. This can be done, at least in a part of the length of the weft guiding comb, so that at least some of the back surfaces 24 of the saw-toothed projections 23 are bevelled as shown at 23' in the relay body 21' of FIG. 5, or has a shape of a part 23'' of a cylindrical surface as illustrated in the relay body 21'' in FIG. 6.

Figure 5:
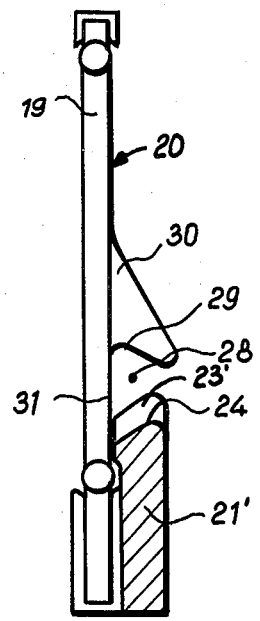
FIG. 5 is a view in section showing a second embodiment of the weft guiding comb of the invention.
Figure 6:
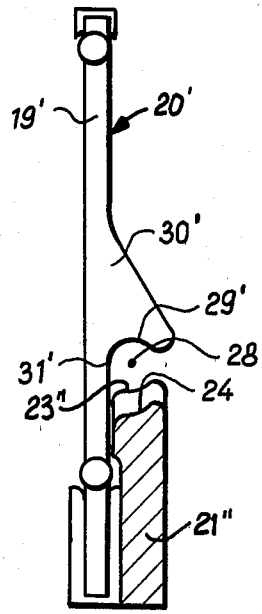
FIG. 6 is a similar view of a third embodiment of the weft guiding comb of the invention.

Alternatively, some or all of the back surfaces 24 of the saw-toothed projections 23 they have the shape of a part of a conical surface narrowing in the direction of insertion of the weft 28. Backs 29 of nose extensions 30 of dents 19 of reed 20 and, at least in a part of the weft guiding comb length, be similarly shaped. Said backs 29 also can be bevelled as illustrated in FIG. 5, or they can have the shape of a part of a cylindrical surface, or the shape of a part of a conical surface narrowing in the direction of insertion of the weft 28.

Figure 4:
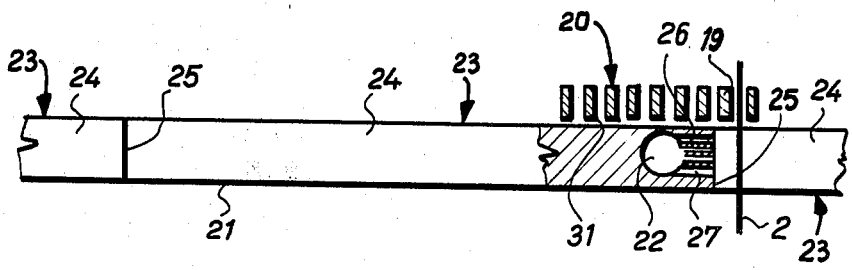
FIG. 4 is a view partially in section and partially in plan of the relay body of the guiding comb, the section being taken along line IV—IV in FIG. 3.

In each face or shoulder 25 of the saw-toothed projections 23 of relay body 21 there is the mouth of one or more relay nozzles 26, 27, as shown in FIG. 4. As explained above, at least two of such nozzles can be mutual parallel to skewed relative to each other. Further, in the case in which the back surface 24 of at least some saw-toothed projections 23 is concave, i.e. for example, has the shape of a part of a cylindrical surface or of a conical surface, it is possible advantageously to terminate at least some of the relay nozzles 26, 27, in one face 25 of a saw-toothed projection 23 in the space between the concave back surface 24 of the next saw-toothed projection 23 and the lower warp threads 2' which it carries. In FIG. 2, the lower warp threads which rest upon the higher portion of the surfaces 24 are designated 2''.

As above explained, relay nozzles 26, 27 of relay body 21 are connected through a distribution element 22'' to a source (not shown) of a carrying medium. It is suitable that relay nozzles 26, 27 are divided into individual sections which are individually connected to the source of carrying medium and are supplied with the carrying medium in a gradual manner in accordance with advance of the weft 28 across the weft guiding comb. One section can be, for example, a group of relay nozzles 26, 27 of one or more successive faces 25 of saw-toothed projections 23 of relay body 21.

Slay 17 carries, coaxially with the weft guiding comb, the main insertion nozzle 32, which in the moment of insertion inserts the weft by means of the carrying medium which is also supplied from a source (not shown). Since the upper warp threads 1 during weaving are above backs 29 of dents 19 of reed 20 during a considerable part of the slay swinging motion, and the lower warp threads 2 abut against back surface 24 of saw-toothed projections 23 of relay body 21 of the weft guiding comb, weft 28 can be inserted into the shed 3 during the whole part of the swinging motion of the slay.

The described embodiments of the weft guiding comb are, of course, preferred embodiments only, and they can be suitably modified within the scope of the invention.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

We claim:

1. In a jet loom having a mechanism for the insertion of weft threads into the loom shed by a stream of fluid weft-carrying medium, said loom having a slay, a reed created by flat dents mounted on the slay to beat up the inserted weft to the fabric, and a weft guiding comb arranged on the slay, the improvement wherein the comb comprises a relay body located under the lower warp threads of the shed at the reed, the wall of the relay body which abuts the lower warp threads of the shed creating one part of the weft guiding comb wall, said one part of the comb wall being provided with saw-toothed projections the back surfaces of which are engaged by the warp threads of the shed in at least the moment of weft insertion, in faces of the saw-toothed projections, transverse to the direction of weft insertion, there being the mouths of relay nozzles pointing in the direction of weft insertion, the other part of the weft guiding comb wall being created by backs of the dents of the reed, the dents being provided with nose extensions above the wall of the relay body which is provided with saw-toothed projections, the length of the nose extensions corresponding to the width of the back surface of the saw-toothed projections of the relay body, in at least a part of the length of the weft guiding comb the distance between the backs of the nose extensions of the dents of the reed and the back surface of the saw-toothed projection of the relay body decreases in a direction toward the binding point of the woven fabric.

2. Mechanism according to claim 1, wherein at least one back surface of the saw-toothed projection of the relay body has the shape of a part of a cylindrical surface.

3. Mechanism according to claim 2, wherein at least one of the relay nozzles located in the face of at least one saw-toothed projection of the relay body terminates in the space between the concave back surface of the next saw-toothed projection of the relay body, and the lower warp threads of the shed abut aganst said back surface of the relay body.

4. Mechanism according to claim 1, wherein the back surface of at least one saw-toothed projection of the relay body has a shape of a part of a conical surface which converges in the direction of weft insertion.

5. Mechanism according to claim 1, wherein in at least a part of the length of the weft guiding comb the backs of the dents of the reed have the shape of a part of a cylindrical surface.

6. Mechanism according to claim 1, wherein at least in a part of the length of the weft guiding comb the backs of the dents of the reed have the shape of a part of a conical surface converging in a direction of weft insertion.

7. Mechanism according to claim 6, wherein at least a section of the relay nozzles located in the faces of the saw-toothed projections of the relay body are individually connected to a source of the said fluid weft-carrying medium.

* * * * *